United States Patent [19]

Remark et al.

[11] 4,075,742

[45] Feb. 28, 1978

[54] ENGAGEMENT LOCK HAVING TWO STAGES OF ENGAGEMENT AND ASSOCIATED METHOD

[75] Inventors: Preben Michael Remark, Tjornevej 10, DK-2800 Lyngby, Denmark; Aksel Johannes Jensen, Copenhagen, Denmark

[73] Assignee: Preben Michael Remark, Lyngby, Denmark

[21] Appl. No.: 711,687

[22] Filed: Aug. 4, 1976

Related U.S. Application Data

[63] Continuation-in-part of Ser. No. 546,895, Feb. 4, 1975, abandoned.

[30] Foreign Application Priority Data

Feb. 5, 1974 Denmark ..... 609/74

[51] Int. Cl.[2] ..... E05C 19/18

[52] U.S. Cl. ..... 24/211 R; 292/307 R

[58] Field of Search ..... 292/318, 327, 319, 307; 24/211

[56] References Cited

U.S. PATENT DOCUMENTS

| | | | |
|---|---|---|---|
| 1,001,878 | 8/1911 | Miller | 292/318 |
| 1,087,020 | 2/1914 | Jones | 292/318 |
| 1,178,758 | 4/1916 | Sandley | 292/318 |
| 1,397,101 | 11/1921 | Kelly | 292/327 |

FOREIGN PATENT DOCUMENTS

| | | | |
|---|---|---|---|
| 86,771 | 5/1920 | Austria | 292/327 |
| 13,493 of | 1909 | United Kingdom | 292/318 |

*Primary Examiner*—Richard E. Moore

*Attorney, Agent, or Firm*—Haseltine, Lake & Waters

[57] ABSTRACT

An engagement lock comprising a rod-shaped locking member and a casing having a cavity for receiving the locking member. A tapered engagement section is formed at one end of the locking member and is inserted into a slit sleeve fixed in the casing to reach a first stage in which a shoulder of the tapered section abuts against the sleeve to prevent axial retraction of the locking member from the casing. The locking member is then axially advanced further into the casing to reach a second stage in which clearance between the rings through which the locking member has passed and the head of the locking member and casing is taken up to conceal the rod-shaped member.

9 Claims, 3 Drawing Figures

ENGAGEMENT LOCK HAVING TWO STAGES OF ENGAGEMENT AND ASSOCIATED METHOD

CROSS-RELATED APPLICATION

This application is a Continuation-In-Part of copending application Ser. No. 546,895 filed Feb. 4, 1975 and now abandoned.

FIELD OF THE INVENTION

This invention relates to a single engagement lock, preferably for containers and to a method of locking flanges or rings of such containers.

BACKGROUND

The lock of the invention is of the type which comprises two members adapted for automatic interlocking engagement on the introduction of one member into a cavity of the other member. The first member is a rod-shaped body with a tapered insertion end and with an abruptly restricted cross-section area slightly rearward of the tapered section so as to form a shoulder, and the second member is a casing with a bore in which is provided a tubular sleeve mounted with limited or no mobility in the axial direction. The sleeve is slit at the end located innermost in the casing and its sectional opening at the slit end is adapted to permit the shoulder of the rod-shaped body to be passed through the tubular sleeve only as a result of the elasticity provided by the slit in the end of the sleeve.

Single engagement locks of this type are known from U.S. Pat. Nos. 3,730,578 and 1,553,188. In the single engagement lock disclosed by U.S. Pat. No. 3,730,578 the second member is a block with throughgoing openings, the diameter of which is smaller at the end where the rod-shaped body is introduced than at the opposite end, which is closed by an inserted sleeve provided with a bore facing the interior of the block and of the same diameter as the smallest diameter of the throughgoing opening. The sleeve extends sufficiently far into the block to form within the block an annular groove for a lock ring which will be expanded on the introduction of the rod-shaped body into the block until the rod-shaped body has penetrated so that the shoulder thereof has passed the lock ring, which then prevents the rod-shaped body from being withdrawn.

Such a single engagement lock is used partly as a padlock but specifically as a seal, for instance, on containers for the transport of goods. The opening of the lock requires the use of force and the fact that the lock is intact indicates that no unauthorized person has had access to the interior of the container.

However, it was found that a lock of this known type could be opened and relocked without leaving any direct signs of the use of force, and thus the security, that the contents on receipt were the same as dispatched, would be lost. Furthermore, the interlocking of the two members was not very secure because the known lock could be opened by impact or by means of a crowbar.

In the single engagement lock disclosed in U.S. Pat. No. 1,553,188 the aforesaid lock ring is replaced by a tubular sleeve open at both ends. Theoretically this results in an improved interlocking connection between the two members of the lock, but this lock can also be broken by a relatively simple operation, since the block member consists of procelain or plastic material, though it could probably not be relocked without leaving signs of the opening.

SUMMARY OF THE INVENTION

It is an object of the instant invention to provide a single engagement lock of the above type which cannot be opened without leaving clear signs of it having been exposed to force and which therefore cannot be re-used. A further object of the invention is to provide a lock of the type which conceals to unauthorized persons the manner in which the lock can be broken.

These objects are accomplished by a single engagement lock whose rod-shaped body has a second tapered section extending rearwardly from the shoulder and wherein there is provided a determined space between the insertion end of the rod and the bottom of the casing when the shoulder has been axially inserted just through the sleeve to a locked position. The rod-shaped body can be further advanced beyond the locking position such that the portion of the rod extending outside the second member of the lock will be concealed by the lock rings of the container. Thus, unauthorized persons without knowledge of the construction will be unable to break the seal.

Opening of the lock is effected by means of a strong pair of shears or scissors inserted between the head of the rod or the casing and the adjacent lock ring. In a first stage the rod-shaped body is axially retracted, by insertion of the shears, to its original locking position, namely until its shoulder strikes the inner end of the sleeve. In the second stage the rod-shaped body is severed.

In a specific embodiment of the lock, the head of the rod-shaped body and/or the block hve substantially conical faces at the ends facing each other. This facilitates the drawing apart of the two members, by means of the shears, sufficiently to make the part of the rod which is concealed by the container lock rings accessible for cutting simply by inserting the shears between the head of the rod or the block and the adjacent lock ring.

BRIEF DESCRIPTION OF THE DRAWING

The invention will be described in greater detail hereafter with reference to the attached drawing, in which.

DETAILED DESCRIPTION

Figure 1:
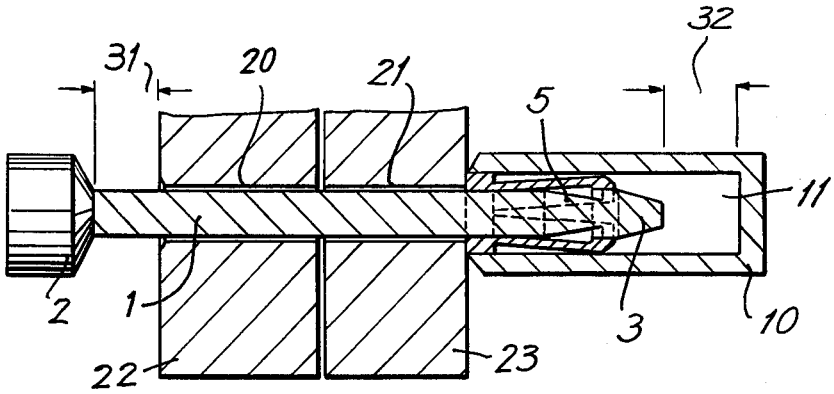
FIG. 1 shows in partial cross-section an embodiment of the single engagement lock in accordance with the invention immediately before the interlocking of the two members is completed in a first stage.
Figure 2:
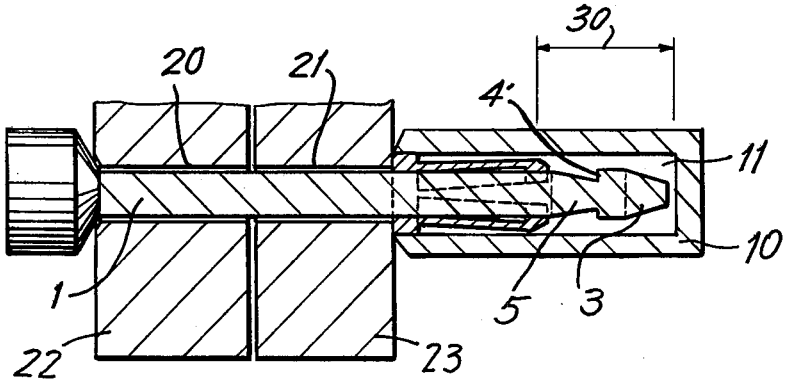
FIG. 2 is similar to FIG. 1 but shows the lock after completion of the interlocking operation in a second stage.

The drawing shows a rod-shaped body 1, preferably of circular cross-section. The body 1 is provided at one end with a head 2 of substantially greater diameter than the rod-shaped body 1, so that the latter, but not the head, can be passed through aligned bores 20, 21 in a pair of lock rings or flanges 22, 23 on a container. At the end opposite the head 2, the rod 1 has a tapered insert section 3. At the rear of the tapered section 3 is an abruptly reduced cross-sections area so as to provide a shoulder 4. From the shoulder 4 the cross-section of the rod 1 again increases in the direction of the head so that a second tapered section 5 is provided.

Figure 3:
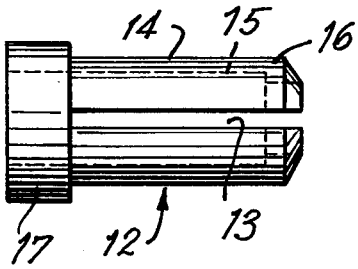
FIG. 3 shows the sleeve of FIGS. 1 and 2 on a larger scale.

The rod-shaped body 1 forms one member of a single engagement lock, the other member of which is a casing 10 having a bore 11 into which a sleeve 12 is introduced and secured, preferably by welding. The sleeve 12, which is shown on a larger scale in FIG. 3 has four longitudinal slits 13 formed in a tubular section 14 located innermost in the block 10. The four slits 13 are distributed equally around the periphery of section 14. The sleeve 12 has a bore 15 in which the rod-shaped body 1 fits, and the sleeve is provided at its free end with a collar 16 facing inwardly towards the bore 15. The opposite end of the sleeve 12 has a head 17 which is pressed into the casing 10 and welded in position. Between the bore 11 of the casing and the free end of the sleeve 12 there is sufficient clearance to enable the sleeve to expand during the interlocking of the two members as will be explained later.

When the insert section 3 of the rod-shaped body 1 has been inserted into the tubular sleeve 12 and the shoulder 4 has passed the innermost end thereof, the sleeve will resume its non-deformed state, and if it is attempted to withdraw or retract the rod-shaped body 1, the shoulder 4 will abut against the end of the tubular sleeve 12 and thus be retained effectively. If a greater force is applied, the tubular sleeve 12 may be deformed so that the section between the slits 13 abut against the walls of the bore 11 in the casing 10. This produces additional resistance to the withdrawal and separation of the rod-shaped body from the casing. The single engagement lock can be opened by cutting the rod-shaped body 1, a portion of which will be left in the cavity of the casing 10, and this portion prevents interlocking with a new rod-shaped body. The number of the container or of an invoice may be stamped on one or on both members to provide proof that the original single engagement lock has not been broken and replaced by a new lock of the same type.

After the interlocking of the rod-shaped body in the casing has been effected by passage of shoulder 4 beyond collar 16 in a first stage, the rod-shaped body is forceably inserted still further into the sleeve 12 whereby the tapered section 5 will again expand the sleeve, and the rod 1 will penetrate more deeply into the lock rings 22, 23 of the container, so as to be substantially concealed by the rings so that it will be even more difficult for persons without knowledge of the construction to break open the lock. The unlocking is effected by forceably pulling the locking bar axially outwards from the casing 10 to the first stage position, thereby providing clearance between the head 2 and ring 22 or between casing 10 and ring 23 to provide access to the rod 1. A strong pair of shears can be inserted between the head 2 or the casing 10 and the respective one of the lock rings to effect this axial retraction of the locking bar. The facing surfaces of the head 2 and the casing 10 are made conical to facilitate the insertion of the shears and the relative displacement of the members to the first stage. In the first step of disengagement, the rod-shaped body is withdrawn until its shoulder 4 abuts the free end of the sleeve 12 and in the second step, the rod-shaped body 1 is severed by the shears.

It is to be noted that a clearance 30 is provided between the free end of sleeve 12 and the inner surface of the opposite wall of the casing in order to allow the rod-shaped body to be displaced from the first stage to the second stage to take-up the clearance 31 that exists between the head 2 and ring 22 when casing 10 is abutted against ring 23. The clearance 30 is also determined so as to take into account the size of tapered section 3 such that the net clearance 32 between the end of section 3 and the inner surface of the opposite wall of casing 10 will be greater than the clearance 31 so that in the second stage the rod 1 can be virtually concealed and rendered inaccessible. In order to insure continued resistance to axial insertion of the locking member 1 into the casing 10 in going from the first stage to the second stage, the clearance 32 must be at least equal to the axial length of the tapered section 5.

What is claimed is:

1. An engagement lock in combination with a pair of locking members of given thickness having aligned apertures, the lock comprising first and second members adapted for automatic interlocking engagement after the first member has been passed through the locking members of the container and is introduced into a cavity provided in the second member, said first member being a rod-shaped body having a head at one end and tapered insertion end at the other end, said tapered end having an abruptly reduced cross-sectional area slightly rearwards of the tapered section so as to form a shoulder, a further tapered section extending from said shoulder on the rod-shaped body, said second member including a casing with a bore, a tubular sleeve open at both ends disposed in said bore with substantially no mobility in the axial direction, said sleeve being slit at the end located innermost within said casing and having a sectional area at that end permitting the shoulder of the rod-shaped body to pass through the tubular sleeve only as a result of the elasticity of the slit end of the sleeve, and wherein in the locked position when the shoulder has passed through the sleeve a clearance is provided between the casing or head and a respective one of the locking members sufficient to permit the insertion of a cutting tool, at least an equal clearance being provided between the insertion end of the rod and the bottom of the casing, so that the rod-shaped body after the locking and against resistance from an expansion of the slit sleeve can be further advanced into the casing to a fully inserted position by sliding contact of the further tapered section in said sleeve until the casing and the head of the body engage respective locking members and completely take-up said clearance, whereby said rod-shaped body will be entirely concealed by the locking members of the container, said head being engageable to retract the rod-shaped body to return the same to said loaded position and thereby provide clearance between the casing or head and one of the locking rings to provide access to said rod-shaped body and enable the same to be cut.

2. The improvement as claimed in claim 1 wherein said slit end of the sleeve expands when said further tapered section of the rod-shaped body passes therethrough.

3. The improvement as claimed in claim 2 wherein said sleeve has a free end with a radially inwardly projecting collar engaging said further tapered section.

4. The improvement as claimed in claim 1 wherein said tapered insertion section is spaced from said casing in axial direction in said locked position by a distance greater than the axial length of the further tapered section.

5. A lock as claimed in claim 1 wherein said shank projects from said casing by a distance which is substantially greater than the magnitude of axial advance of the first member into the casing in going from the locked position to the further advanced position.

6. A lock as claimed in claim 5 wherein said head and said casing have surfaces facing one another, said surfaces being conical to facilitate insertion of a cutting tool to relatively move the first member and the casing to said first stage.

7. A method of locking together two members having aligned bores, said members comprisig inserting a locking member into the aligned bores of the two members to be locked together, the locking member being of rod-shape and formed at one end with a head which cannot pass through the bores, inserting the opposite end of the locking member into a casing placed on the opposite side of the members to be locked together, securing the locking member against axial retraction from the casing in a first stage of engagement in which a space is formed between the casing or head and a respective one of the members to be locked together, and forcing the locking member axially further into the casing to a second stage of engagement to take-up clearance between the head and casing and the two members to be locked together to conceal said locking member in the region between said head and said casing.

8. A method as claimed in claim 7 comprising frictionally engaging said locking member in said casing in said second stage.

9. A method as claimed in claim 7 wherein for unlocking the two members, the locking member is forceably retracted axially to return to said first stage, and the locking member is severed by inserting a cutting tool into said clearance now formed between the head and casing and said two members.

* * * * *